United States Patent [19]

Trick

[11] Patent Number: 4,666,051

[45] Date of Patent: May 19, 1987

[54] IN CAP MEDICATION REMINDER

[76] Inventor: O. Lee Trick, 10002 Green Tree, Houston, Tex. 77042

[21] Appl. No.: 757,441

[22] Filed: Jul. 22, 1985

[51] Int. Cl.[4] ..... G09F 9/00

[52] U.S. Cl. ..... 215/230; 116/308

[58] Field of Search ..... 116/308; 215/230, 220; 206/534

[56] References Cited

U.S. PATENT DOCUMENTS

| | | | |
|---|---|---|---|
| 493,851 | 3/1893 | Adsit . | |
| 3,151,599 | 10/1964 | Livingston | 116/308 |
| 3,638,603 | 2/1972 | Conover | 116/308 |
| 4,011,829 | 3/1977 | Wachsmann et al. | 116/308 |
| 4,345,541 | 8/1982 | Villa-Real | 116/308 |
| 4,347,804 | 9/1982 | Villa-Real | 116/308 |
| 4,365,722 | 12/1982 | Kramer | 215/220 |
| 4,405,045 | 9/1983 | Villa-Real | 206/534 |
| 4,528,933 | 7/1985 | Allen | 116/308 |

*Primary Examiner*—Donald F. Norton

*Attorney, Agent, or Firm*—T. Carter Pledger

[57] ABSTRACT

A memory aid is provided for use with a vial for containing medicine taken in doses at predetermined times. The aid comprises an attachment base for attachment to a conventional top for the vial, an attachment top, a reminder for moving relative to the attachment top, and a locking element for preventing relative movement between the reminder and the attachment top in one direction and permitting relative movement in the other direction.

16 Claims, 21 Drawing Figures

FIG. 1
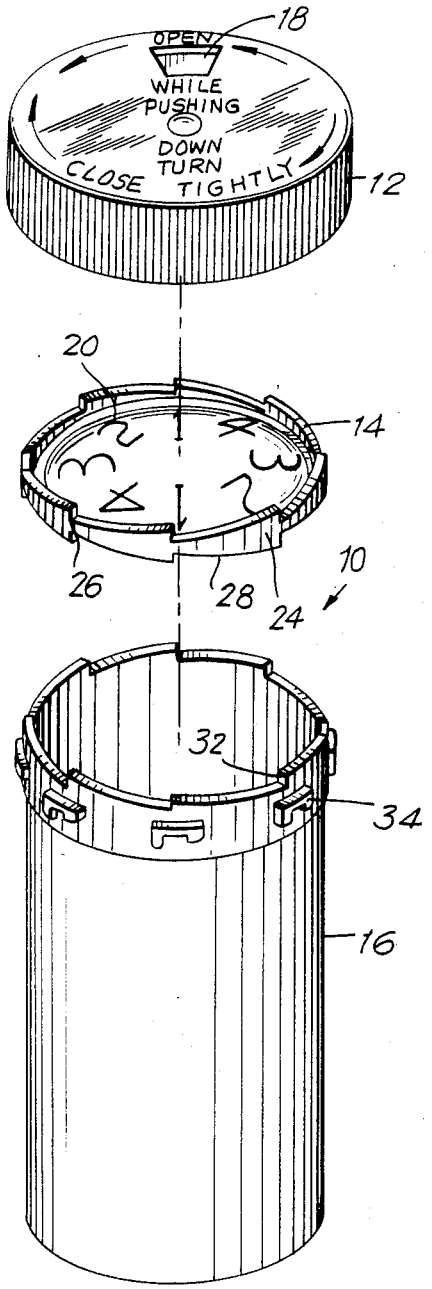
FIG. 2
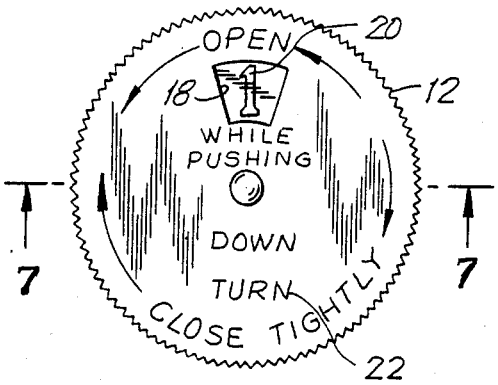
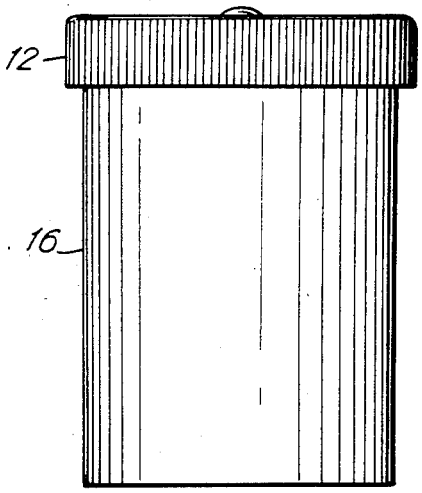
FIG. 3

IN CAP MEDICATION REMINDER

BACKGROUND OF THE INVENTION

This invention relates to memory aids, and more particularly, to a medication container with a remainder completely contained within the cap of the container.

One of the major factors in a patient's non-compliance with the taking of medication is the problem of not remembering whether the medication was taken at the last scheduled dosage time. As a result, devices to aid the patient's memory have been developed. These devices have been directed to a tray or similar device that holds the medication. One dose is placed in each scheduled time slot in advance of the administration of the medication. As the medication is used, the slots in the tray are emptied to provide a visual indication of the time for the next dose.

Numerous problems have prevented the widespread acceptance of these devices. A patient must admit that his memory is poor enough to require such an aid. Most persons see this as a threat to the ego, and therefore, resist the use of such a device. Most patients do not suffer from a severe memory detriment, that is, a frequent inability to remember when the last dosage was taken, but rather, they only occasionally forget to take the medication. On these occasions, a patient would appreciate a device to aid his memory, but the incidence of forgetfulness is so small that it does not appear to warrant the use of a separate reminder.

Although some medications are packaged by pharmaceutical companies in a scheduled dispensing device, such as birth control pills, very few medications enjoy such universally indicated dosage schedules. Most medications must be tailored to each individual patient, and therefore, cannot be pre-packaged in a self-scheduling dispenser. Accordingly, either the pharmacist or the patient must place the medication in a separate scheduling device for dispensing the medicine at the appropriate interval. A separate scheduling device assembled and used by the patient, unfortunately, provides undesirable opportunities for contamination or spillage.

OBJECTS AND SUMMARY OF THE INVENTION

It is therefore an object of the present invention to provide a medication container with a memory aid for use in reminding patients to take medicine that overcomes the disadvantages of the prior art.

It is another object of the present invention to provide a medication container with a memory aid for taking medicine that is completely included in the cap of the container.

It is still a further object of the present invention to provide a memory aid for use in reminding patients to take medicine that is kept with the medicine at all times.

It is yet another object of the present invention to provide a medication container with an integral memory aid.

It is yet a further object of the present invention to provide a medication container with a memory aid for use in reminding a patient to take medicine that will not result in contamination or spillage of the medicine.

It is still a further object of the present invention to provide a medication container with a memory aid for use in reminding a patient to take medicine that can accommodate different dosage schedules for the medicine.

It is yet another object of the present invention to provide a medication container with a reminder that is easily incorporated into existing medicine containers.

In accord with one aspect of the present invention, a memory aid for use with a vial for containing medicine taken in doses at predetermined times comprises a top for covering an opening of the vial, a reminder means integral with the top for indicating a time for taking one of the doses of the medicine, the reminder means including indicating means for indicating a sequence of the predetermined times, cover means for selectively covering the indicating means to indicate a time for taking the medicine, means for rotatably connecting the cover means to the top so that the cover means rotates with respect to the indicating means, and an upstanding tab dimensioned to be grasped by a human hand for rotating the cover means with respect to the top.

In accord with another aspect of the present invention, a memory aid for use with a vial for containing medicine taken in doses at predetermined times comprises a ratchet formed on the perimeter of the opening of the vial, a top mounted on the vial and having a ratchet located on an inner surface thereof, a reminder means for rotating with respect to the top to indicate one in a sequence of times for taking one of the doses of the medicine, and locking means for preventing relative rotation between the reminder means and the top in one direction and permitting relative rotation between the remainder means and the top in the other direction, the locking means including a first ratchet operable in a first direction for cooperating with the ratchet of the top, and a second ratchet operable in the opposite direction for cooperating with the ratchet on the vial.

In accord with still another aspect of the present invention, a memory aid for use with a vial for containing medicine taken in doses at predetermined times, the vial having a top, comprises an attachment top means, a reminder means for moving relative to the attachment top means to indicate a sequence of times for taking the doses of the medicine, a locking means for preventing relative movement between the remainder means and the attachment top means in one direction and permitting relative movement between the reminder means and the attachment top means in another direction, and an attachment base means positioned within the attachment top means for coupling the attachment top means to the top of the vial, the attachment base means being dimensioned to contain the top of the vial.

Other objects, features and advantages of the present invention will be apparent from the following detailed description taken in conjunction with the accompanying drawings.

BRIEF DESCRIPTION OF THE DRAWINGS

FIG. 1 is an exploded, perspective view of one embodiment of a memory aid used in a medication container in accord with the present invention;

FIG. 2 is a plan view of the embodiment of FIG. 1;

FIG. 3 is a side view of the embodiment of FIG. 1;

DESCRIPTION OF THE PREFERRED EMBODIMENTS

Figure 4:
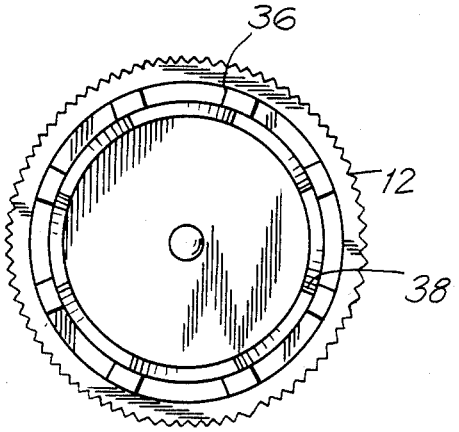
FIG. 4 is a bottom view of a top of the embodiment of FIG. 1.
Figure 6:
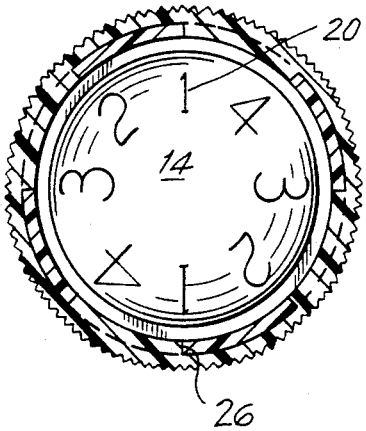
FIG. 6 is a plan view of the element of FIG. 5.

Referring to the drawings, and initially to FIGS. 1 through 3 thereof, an embodiment of a medication container 10 that automatically advances the time indicated for a dose of medicine to be taken is illustrated and comprises a top 12, a locking element 14, and a vial 16. Top 12 includes a window or aperture 18 through which a sequence of indicators or indicia 20 is visible. In the illustrated embodiment, indicators 20 are numerals formed on and integral with locking element 14. Top 12 is illustrated as including printing 22 to provide directions or the like for opening and closing medication container 10.

Locking element or insert 14 is disposed between top 12 and vial 16. Locking element 14 has a disc-shaped central body 24 having indicators 20 formed thereon the includes a first ratchet 26 positioned on the perimeter of the disc-shaped central body 24 and extending substantially above a median plane therethrough. The teeth of ratchet 26 face a first direction, as seen from the side (see FIG. 5); in the illustrated embodiment, the teeth of ratchet 26 face to the right.

Locking element 14 also includes a second ratchet 28 positioned on the perimeter of the disc-shaped central body 24 and extending substantially below the median plane thereof. It is to be appreciated that the teeth of second ratchet 28 face in the same direction as the teeth of first ratchet 26 (see FIG. 5).

Locking element 14 has a dome-shaped central portion 30 extending substantially above the median plane. The function of dome-shaped central portion 30 will be described more fully hereinbelow.

Vial 16 has a plurality of ratchet teeth 32 formed on the perimeter of the opening thereof for engaging with ratchet 28 of locking element 14. A plurality of bosses 34 are formed on the outer peripheral surface of vial 16 surrounding the opening thereof and cooperate with clinching lugs 36 (See FIG. 4). Bosses 34 and clinching lugs 36 comprise the functional elements of the so-called "child-resistant" cap now in widespread use.

It is to be appreciated that the "child-resistant" cap functions to prevent a child from opening the medicine container by requiring the top to be depressed before it is turned and opened.

As illustrated in FIG. 2, indicator 20 of locking element 14 can be viewed through window 18 in top 12. As explained more fully hereinbelow, when top 12 of medicine container 10 is opened, top 12 rotates relative to locking element 14 whereby the next indicator 20 in the sequence rotates into view through window 18.

The instructions provided on top 12 in the embodiment of FIG. 2 are illustrative only, as will be appreciated by one of skill in the art.

Top 12 of medicine container 10 has a substantially flat upper surface with shoulders extending over the upper edge of vial 16, as seen most clearly in FIG. 3.

A ratchet 38 (see FIG. 4) is located on an inner surface of top 12 and cooperates with ratchet 26, as discussed more fully hereinbelow. Clinching lugs 36 cooperate with bosses 34 to prevent a child from removing top 12.

Figure 5:
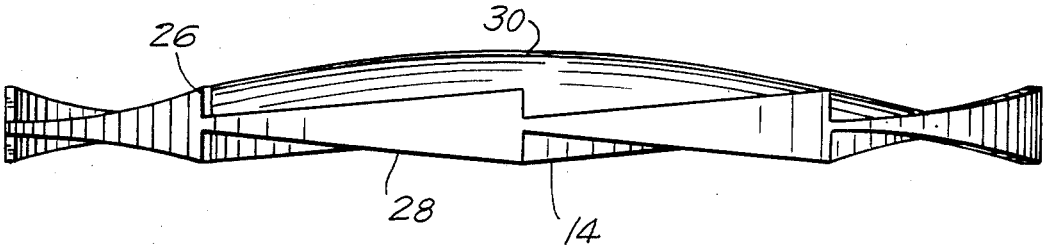
FIG. 5 is a side view of an element of the embodiment of FIG. 1.

Dome-shaped central portion 30 of locking element 14 (see FIG. 5) is a relatively elastic element that cooperates with the inner surface of top 12 normally to bias locking element 14 to permit relative rotation between locking element 14 and top 12. As illustrated in FIG. 5, the teeth of ratchet 26 and the teeth of ratchet 28 face the same direction. Hence, ratchet 26 is operable to engage ratchet 38 when top 12 is rotated in a clockwise direction, as seen from above. Ratchet 28 is operable to engage ratchet 32 when top 12 is rotated in a counterclockwise direction, as seen from above. Ratchet teeth 26 extend substantially above the median plane through disc-shaped central body 24, while ratchet teeth 28 extend substantially below the median plane.

Figure 7:
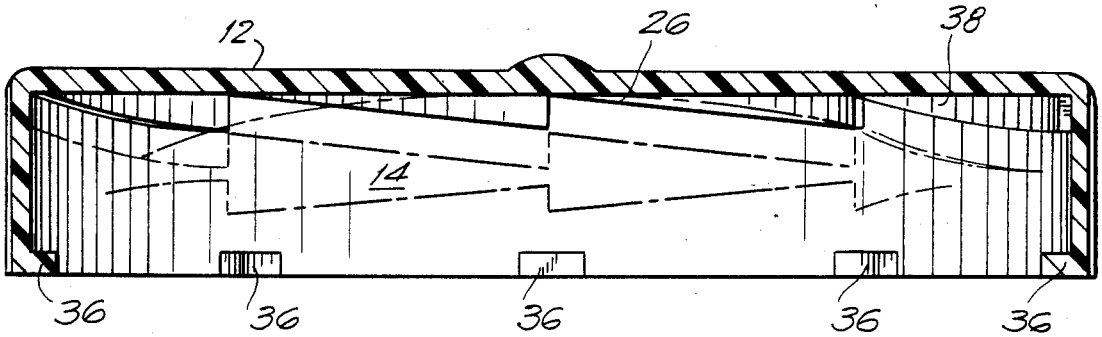
FIG. 7 is a cross-sectional view taken along the lines 7—7 of FIG. 2.
Figure 8:
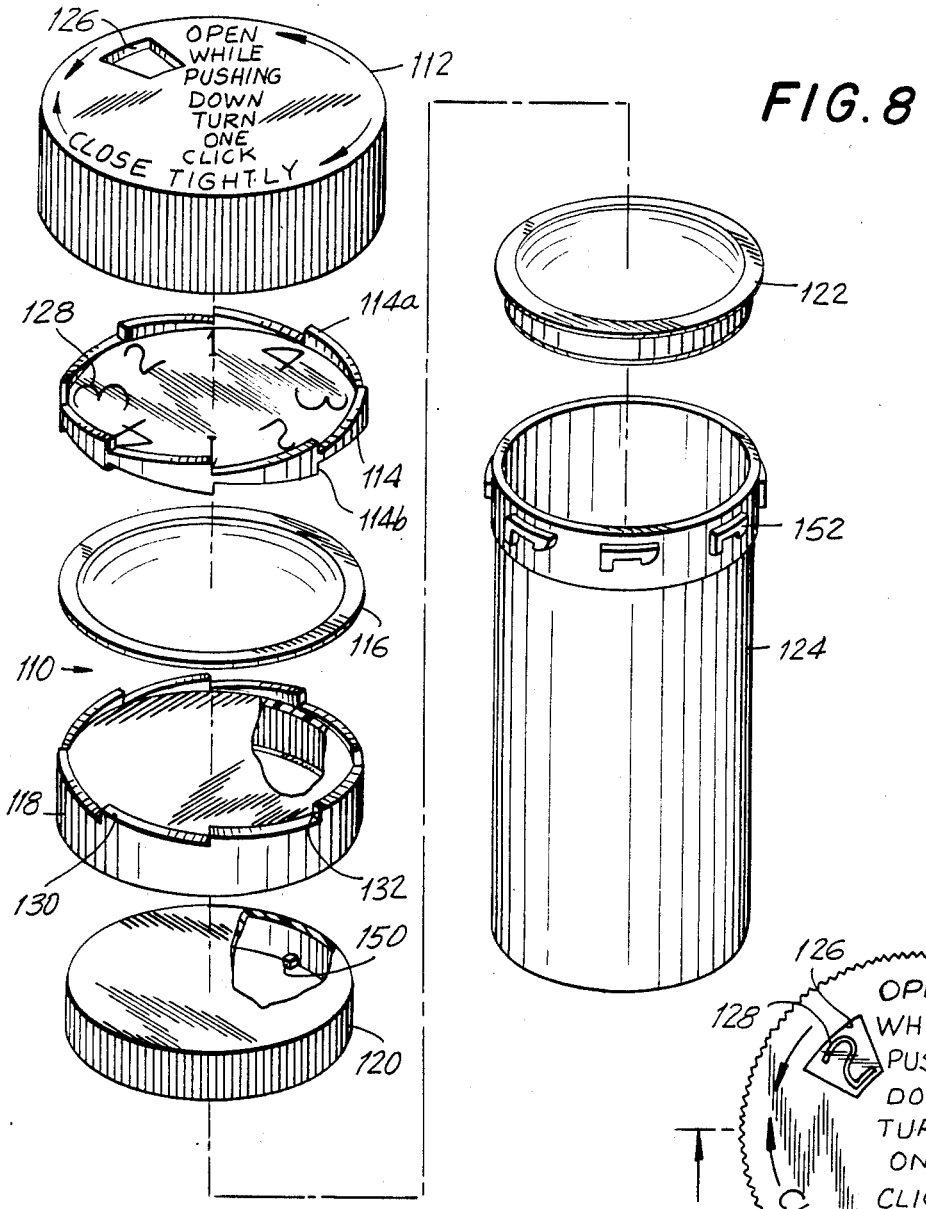
FIG. 8 is an exploded, perspective view of a second embodiment of a memory aid in a medication container in accord with the present invention.

As illustrated most clearly in FIG. 7, clinching lugs 36 are formed along the edge of the shoulder of top 12. Ratchet 38 extends downwardly from the inner surface of top 12.

The operation of the embodiment of FIGS. 1 through 7 of the present invention is next to be described. The operation of the device derives from the locking action of locking element 14 to either vial 16 or top 12. As top 12 is depressed and turned counterclockwise to open the medicine container 10, locking element 14 is locked to vial 16 through engagement of ratchet 28 with ratchet 32. Top 12 slides over locking element 14 and advances the indicator observed through window 18 by one. When top 12 is depressed and turned clockwise to close medication container 10, locking element 14 rotates whereby ratchet teeth 26 engage ratchet 38 of top 12. Locking element 14 rotates with respect to vial 16, that is, ratchet 28 does not engage ratchet 32 of vial 16. It is to be appreciated that the indicator 20 observed through window 18 does not change due to the locking action of ratchet 26 and ratchet 38.

It is to be further appreciated that the indicator 20 observed through window 18 changes by one as the top 12 is removed. A patient can rotate indicator 20 through more than one position if desired.

If top 12 is turned clockwise or counterclockwise without being depressed, clinching lugs 36 remain locked in the notches of bosses 34 through the biasing action of the dome-shaped central portion thereby preventing rotation of cap 12 in either direction. The "child-resistant" feature of the assembly is maintained.

FIGS. 8 through 11 illustrate an alternate embodiment of the present invention in which the memory aid portion of the embodiment of FIGS. 1 through 7 can be used with a conventional medication container. Medication container 110 of FIG. 8 comprises an attachment top 112, a locking element 114, a dome-shaped member 116, an attachment base 118, a cap 120, a child-resistant insert 122, and a vial 124. It will be appreciated that top 120, child-resistant insert 122 and vial 124 are conventional elements currently available in the marketplace.

Attachment top 112 includes a viewing window or aperture 126 through which indicators or indicia 128 are visible. Indicators 128 are formed on and are integral with locking element 114. Locking element 114 corresponds in general to locking element 14 of the previous embodiment, although element 114 has no dome-shaped central portion, and has instead, a disc-shaped central portion, with a median plane therethrough. An upper or first ratchet 114*a* of locking element 114 is operable, when attachment top 112 is rotated in a clockwise direction, to engage ratchet 138 of attachment top 112. A lower or second ratchet 114*b* of locking element 114 is operable, when attachment top 112 is rotated in a counterclockwise direction, to engage ratchet 130 of attachment base 118.

Attachment base 118 includes ratchet 130 with teeth 132 upstanding therefrom and positioned on the perimeter thereof. Teeth 132 face in the same direction as teeth 32 of the embodiment of FIG. 1. Ratchet 130 functions in the same manner as ratchet 32 of FIG. 1.

Dome-shaped member 116 is positioned between locking element 114 and attachment base 118. Dome-shaped member 116 functions to bias locking-element 114 in a manner similar to the function of the dome-shaped portion 30 of locking element 14.

Figure 9:
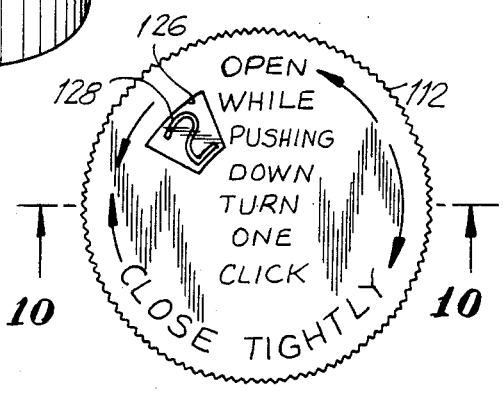
FIG. 9 is a plan view of the embodiment of FIG. 8.

As seen most clearly in FIG. 9, indicators 128 are visible through viewing window 126 of top 112.

Figure 10:
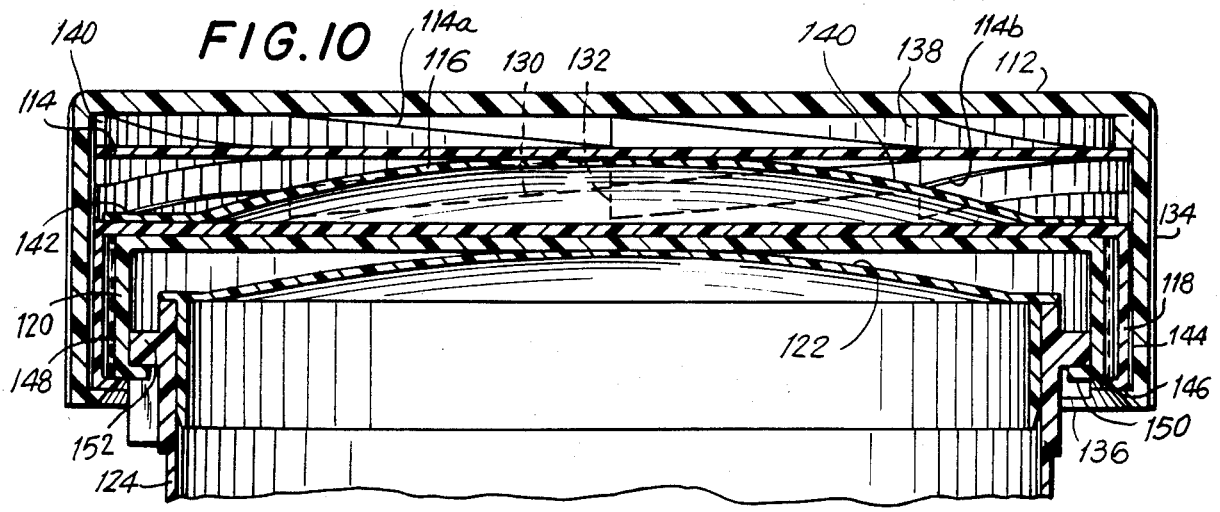
FIG. 10 is a cross-sectional view taken along the lines 10—10 of FIG. 9.
Figure 11:
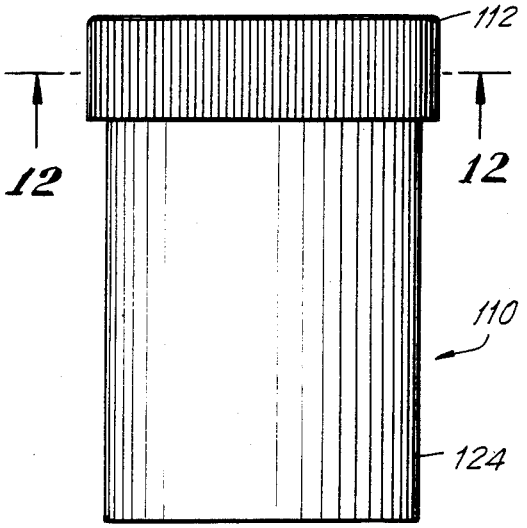
FIG. 11 is a side view of the embodiment of FIG. 8.

Referring to FIG. 10, attachment top 112 includes an extended shoulder portion 134 with a snap-on retaining ring 136 positioned about the bottom peripheral edge thereof. Attachment top 112 slips over attachment base 118 to retain locking element 114, dome-shaped member 116, and attachment base 118 in an operating position. Top 112 includes a ratchet 138 located on an inner surface thereof. Ratchet 138 corresponds to ratchet 38 in FIG. 7.

Dome-shaped element 116 includes a dome-shaped portion 140 that contacts locking element 114 and normally biases locking element 114 to permit relative rotation between locking element 114 and top 112. Dome-shaped element 116 includes a flat edge portion 142.

Attachment base 118 includes a shoulder portion 144 and a retaining ring 146. Retaining ring 146 is positioned about the bottom peripheral edge of shoulder 144 and is dimensioned to snap over top 120, in a fashion similar to retaining ring 136.

Shoulder 144 of attachment base 118 is dimensioned to securely cover shoulder 148 of top 120. In other words, top 120 "fits within" the space or cavity defined by shoulder 144 and retaining ring 146 of attachment base 118.

Shoulder 134 of of attachment top 112 is dimensioned so that attachment top 112 includes therein locking element 114, dome-shaped element 116, and attachment base 118.

Top 120 includes clinching lugs 150 that cooperate with bosses 152 on vial 124 to prevent top 120 from being removed by a child. Top 120 is a conventional top known to those of ordinary skill in the art.

Figure 12:
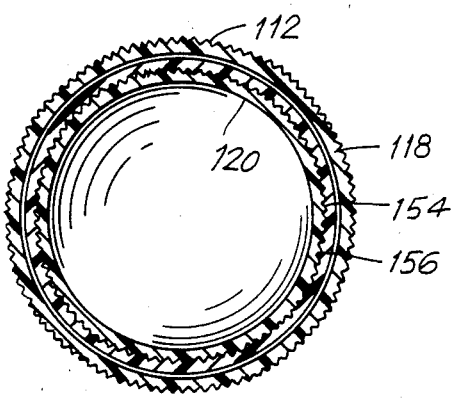
FIG. 12 is a cross-sectional view taken along the lines 12—12 of FIG. 11.

FIG. 12 illustrates the attachment of attachment top 112, attachment base 118, and top 120. Top 120 includes grooves or ridges 154 formed parallel to an axis through vial 124. Attachment base 118 includes, on the inner surface of shoulder 144, grooves the ridges 156 for engaging corresponding grooves and ridges 154 on shoulder 148 of top 120. Attachment top 112 and attachment base 118 are made of a sufficiently flexible material, such as a plastic material, whereby retaining ring 136 can be stretched to extend over the outer diameter of attachment base 118. In a corresponding fashion, attachment base 118 is made of a sufficiently flexible material so that retaining ring 146 can be stretched to extend over the outer diameter of top 120. Attachment top 112 is sufficiently flexible to adhere securely to attachment base 118. In a like manner, attachment base 118 is sufficiently flexible to adhere to top 120. Attachment top 112 and attachment base 118 are dimensioned sufficiently to transmit rotational forces from a patient's hand through attachment top 112 to top 120 on vial 124 without significant slippage.

The operation of the embodiment of FIGS. 8 through 11 as an in-cap counter is next to be described. As attachment top 112 is pushed down and turned counterclockwise, pressure is applied on the bottom of locking element 114 causing the lower ratchet teeth 114*b* to engage ratchet 130 of attachment base 118. At the same time, clinching lugs 150 of cap 120 are pushed below and free of the corresponding notch in bosses 152 on the outer peripheral surface of vial 124. As further counterclockwise motion is applied, the locking action of ratchet 114*b* of locking element 114 with ratchet 130 of attachment base 118 causes attachment base 118 to rotate in a counter-clockwise direction.

Rotational forces from attachment top 112 are transmitted through engagement of corresponding grooves and ridges 154, 156, to cap 120 to cause cap 120 to rotate thereby as one unit with attachment base 118. Rotation of cap 120 and attachment base 118 in the counterclockwise direction stops when clinching lugs 150 engage the lateral upright edges of bosses 152 on the outer surface of vial 124. As further counter-clockwise motion is provided with downward pressure, ratchet 138 on the bottom inner surface of attachment top 112 slides over ratchet 114*a* of locking element 114. An audible "click" can be heard as the indicator 128 viewed through viewing window 126 is advanced by one count.

It is to be appreciated that, if further counterclockwise motion is applied to attachment top 112 with downward pressure maintained, the indicator 126 seen through viewing window 128 with continue to advance with a single audible click for each count. As will be apparent to those of ordinary skill in the art, the count indicated by indicators 128 can be reset in such a fashion.

At the conclusion of the counter-clockwise motion, cap 120 and attached assembly are free for removal with the application of upward force. Clinching lugs 150 on the inner side surface of cap 120 slide up between the free spaces between bosses 152 on the outer side surface of vial 124. The entire assembly can be removed and the contents of vial 124 are open for examination or removal. Attachment top 112 cannot be removed from attachment base 118 due to the retaining function of retaining ring 136. In a similar fashion, retaining ring 146 prevents removal of attachment base 118 from cap 120.

For replacement, the entire assembly 112, 114, 116, 118, 120, 122, is placed on vial 124 so that clinching lugs 150 on the inner side surface of cap 120 are positioned in the free areas between bosses 152 on the outer side surface of vial 124. As downward pressure is applied, clinching lugs 150 on the inner surface of cap 120 slide downward in the free spaces between bosses 152 on the outer side surface of vial 124. Simultaneously, ratchet 138 on the bottom of the inner surface of attachment top 112 engages ratchet 114*a* of locking element 114. As clockwise motion is imparted with downward pressure, ratchet 138 engages upper ratchet 114*a* of locking element 114. The locking action between ratchet 138 and upper ratchet 114*a* of locking element 114 and the friction between lower ratchet 114*b* and ratchet 130 causes attachment base 118, locking element 114 and attachment top 112 to rotate as a single unit. Cap 120 rotates therewith due to the interlocking action of the corresponding grooves and ridges 154, 156 on the inner surface of shoulder 144 of attachment base 118 and shoulder 148 of cap 120. Clinching lugs 150 on the inner surface of cap 120 move to a position below the notches in bosses 152 on the outer surface of vial 124. Clinching lugs 150 engage bosses 152 to prevent further clockwise motion of cap 120 and attachment base 118.

It is to be appreciated that if further clockwise motion is imparted, lower ratchet 114*b* of locking element 114 slides over ratchet 130 on attachment base 118, and an audible click can be heard. Attachment top 112 remains locked to locking element 114 due to the locking action of the ratchet 138 with upper ratchet 114*a* of locking element 114. It is to be further appreciated that the count or indicator 128 seen through window 126 continues to be viewed, with no change. When downward pressure is released, child-resistant insert 122 biases top 120 to cause clinching lugs 150 to engage the notches in bosses 152.

If attachment top 112 is turned in either the clockwise or counter-clockwise direction without downward pressure, the biasing action of dome-shaped element 116 keeps attachment cap 112 locked to locking element 114 through engagement of ratchet 138 and upper ratchet 114*a* of locking element 114. At the same time, lower ratchet 114*b* of locking element 114 does not engage ratchet 130 of attachment base 118. Attachment top 112 and locking element 114 move as a single unit, while attachment base 118 and cap 120 remain substantially stationary. The indicator 128 seen through window 126 is retained, and cap 120 cannot be removed from vial 124 without the application of downward pressure.

It is to be appreciated that, in accord with the embodiment of FIGS. 8 through 12, the child-resistant function used in the prior art medication container is retained. It is to be further appreciated that no modification of the vial, child-resistant insert, or cap is required.

Since medication is dispensed in different sizes of vials, and at different prescribed schedules, in cap medication reminders in accord with the present invention must be provided for all sizes of vials currently in use, as well as for commonly utilized dosage schedules. For dosage schedules of every six hours, once, twice, or four times daily, ratchets 38, 138, 26, 28, 114*a*, 114*b*, 32 and 130 must be placed at 45 degree increments. For dosage schedules of three times daily, every four hours, and every eight hours, ratchets 38, 138, 26, 28, 114*a*, 114*b*, 32 and 130 must be placed at 60 degree intervals.

Current manufacturers supply vials of 12 drams and smaller with six bosses. Larger vials are equipped with eight bosses. Since the counting action is activated by the locking action of clinching lug 150 engaging the lateral edges of bosses 152, but is otherwise independent of bosses 152 on vial 124, attachments with 45 or 60 degree increment ratchets can be used on vials with eigher eight lugs at 45 degree increments, or six lugs at 60 degree increments. Thus, all dosage schedules can be used interchangeably on all sizes of vial 124.

It is to be appreciated by those of ordinary skill in the art that the directions for use of the in-cap medication reminder can be placed on the top of attachment cap 112. The instruction to open while pushing down and to turn only one click is added for proper use.

FIGS. 13 through 16 illustrate an alternate embodiment of the present invention in which the memory aid is manually operated. Medication container 210 of FIG. 13 comprises a top 212, a child-resistant insert 214, and a vial 216. The child-resistant mechanism also includes bosses 234 on vial 216, and clinching lugs (not shown) formed on the inner edge of the shoulder of top 212.

In the illustrated embodiment, a memory aid 218 is formed or positioned on top 212. Memory aid 218 includes a dial 220, a boss 222 formed on top 212, indicators 224 formed on top 212, a tab 226 upstanding from dial 220, and a coupling element 228. Coupling element 228 passes through an aperture 232 in top 212 to couple dial 220 to top 212.

Upstanding tab 226 is dimensioned to be easily grasped by a human hand and used to impart relative rotation between dial 220 and top 212, as discussed more fully hereinbelow.

Boss 222 comprises a plurality of ridge-shaped elements positioned along the radii of top 212. In the illustrated embodiment, one ridge-shaped element is located between each indicator 224 and extends less than the complete radius of top 212, i.e., does not extend to either aperture 232 or the outer peripheral edge of top 212. Other arrangements will be suggested to those of skill in the art.

Dial 220 includes a viewing window or aperture 218 through which indicator 224 can be observed. In addition, instructions 236 or the like can be imprinted on dial 220, similarly to the instructions 22 of the embodiment of FIG. 1.

Figure 15:
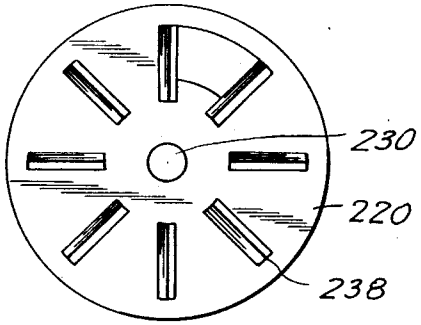
FIG. 15 is a view of the underside of a dial of the embodiment of FIG. 13.
Figure 14:
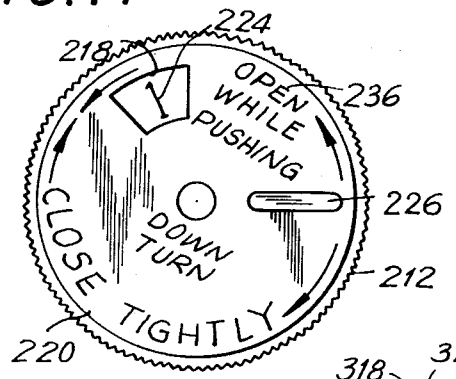
FIG. 14 is a plan view of the embodiment of FIG. 13.

The underside of dial 220, in FIG. 15 includes a plurality of grooves 238 dimensioned to cooperate with boss 222 of top 212. Dial 220 is made of a semi-flexible material permitting dial 220 to ride over bosses 222 on top 212 while being retained by element 228. Element 228 has a small amount of vertical play between dial 220 and top 212 to permit such overriding rotation.

In operation, each time a dose of medicine is to be taken or has been taken, the patient grasps upstanding tab 226 and rotates dial 220, moving dial 220 to the number imprinted on top 212 indicating the time for the last (or next) dose of medicine. Bosses 222 on top 212 engage the grooves 238 on the bottom of dial 220. The semi-flexible construction of dial 220 allows dial 220 to ride over bosses 222 on top 212 while being retained by element 228. As grooves 238 on dial 220 snap into place on bosses 222 of top 212, further rotation of dial 220 is not possible without further manual pressure on upstanding tab 226 due to the limited vertical movement provided between dial 220 and top 212 by element 228. Clearly, the indicator 220 observed through 218 is retained until dial 220 is manually rotated again.

As will be appreciated by one of ordinary skill in the art, child-resistant insert 214, bosses 234, and the clinching lugs on top 212 can be eliminated. In such an instance, the medication reminder would operate as hereinbefore described, but the medicine would not be protected from accidental use by a child.

Figure 17:
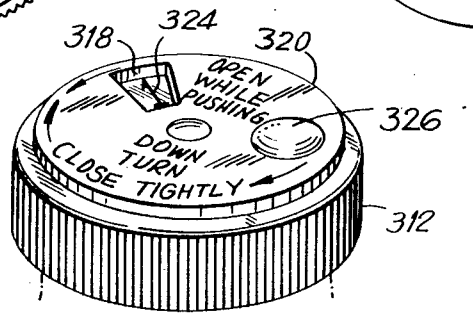
FIG. 17 is a perspective view of an alternate example of the third embodiment of a medication container in accord with the present invention.

FIG. 17 illustrates an alternate example of the third embodiment wherein upstanding tab 226 is replaced with a groove or indentation 326 formed in dial 320. Groove or indentation 326 is dimensioned to receive the tip of a human finger, and is used to rotate dial 320. It is to be appreciated that dial 320 is slightly thicker or deeper than dial 220 of FIG. 13 to accommodate the depth of groove or indentation 326.

Figure 13:
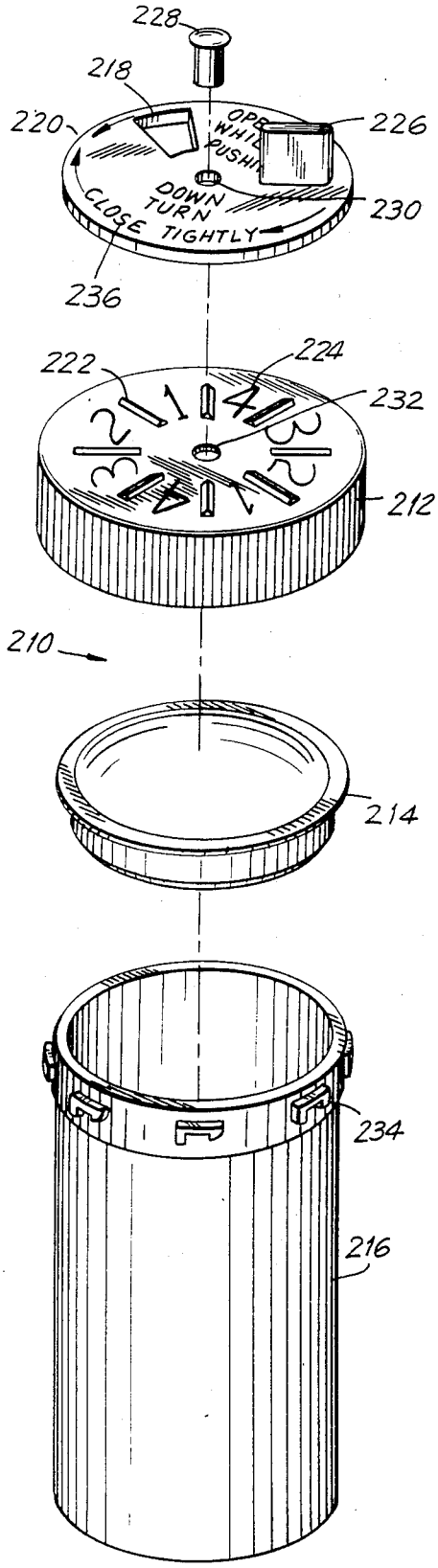
FIG. 13 is an exploded, perspective view of a third embodiment of a medication container in accord with the present invention.
Figure 16:
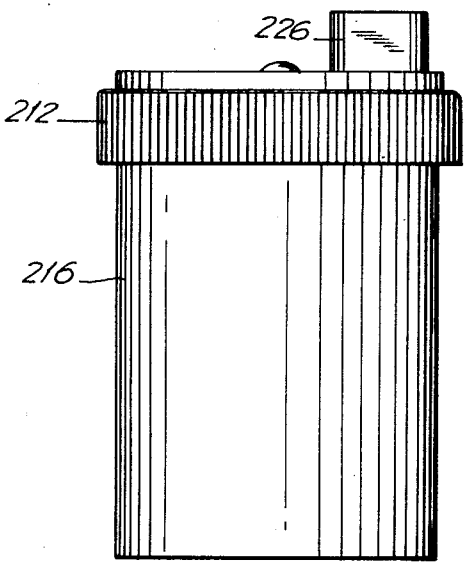
FIG. 16 is a side view of the embodiment of FIG. 13.

FIGS. 18A through 18D illustrate four arrangements of indicators 224 on top 212 of the embodiment of FIG. 13. A person of ordinary skill in the art will appreciate that indicators 20, 128 on locking elements 14, 114 can be similarly arranged.

Figure 18B:
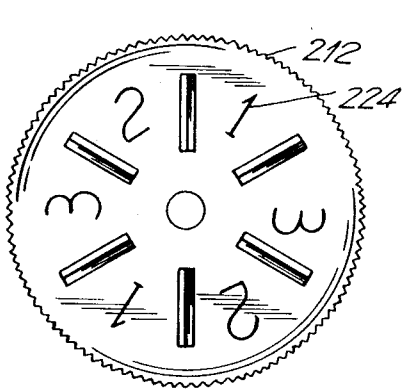
FIGS. 18A through 18D illustrate alternate indicating elements for use in the embodiment of FIGS. 13 and 17.
Figure 18A:
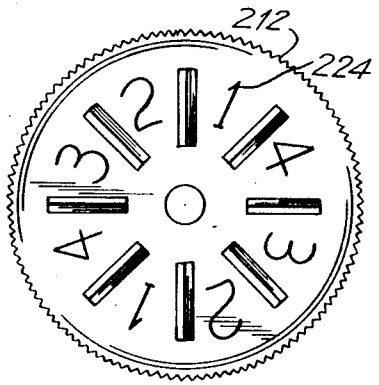

In FIG. 18A, indicators 224 are numerals 1, 2, 3 and 4 provided to indicate that the medicine is to be taken four times daily or every six hours. In the illustrated embodiment, the numbers repeat twice, so that two days are depicted with indicators 224 for four times daily, or one day for every six hour schedules. A 45 degree angle separates each ridge-shaped element of boss 222.

In FIG. 18B, indicators 224 are numerals 1, 2 and 3, indicating the medicine is to be taken three times daily or every four or eight hours. A 60 degree angle separates each ridge-shaped element of boss 222.

Figure 18C:
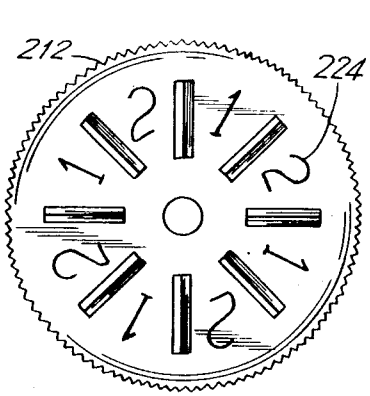

In FIG. 18C, indicators 224 are numerals 1 and 2, indicating the medicine is to be taken twice a day. A 45 degree angle separates each ridge-shaped element of boss 222.

Figure 18D:
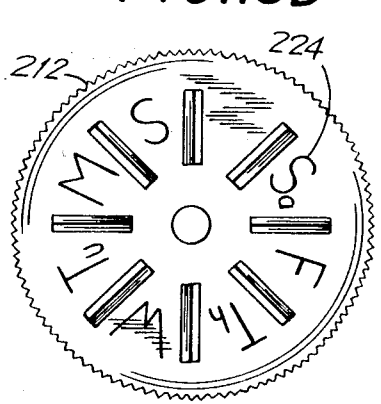

In FIG. 18D, indicators 224 are abbreviations of the days of the week, "SU", "MO", "TU", "WE", "TH", "FR", and "SA", indicating medicine taken daily. It will be appreciated that a blank portion or segment is positioned between the Saturday and Sunday indicators 224, since there are only seven days in a week, while bosses 222 divide top 212 into eight portions or segments.

It is to be appreciated that the memory aid or reminder of the present invention can be used with a conventional medicine container or vial with little or no modification, thus encouraging its widespread acceptance. For example, in the embodiments of FIGS. 8 through 17, no modification of the vial is required. In the embodiment of FIGS. 1 through 7, only ratchet teeth 32 need be included on vial 16. Vial 16 must be furnished with bosses 34 at 45 degree and 60 degree increments. Top 12 must be modified from the prior art top to include ratchet 38 and window 18.

The pharmacist must match the appropriate vial and insert-cap assembly with the prescribed dosage schedule, of course. Color-coding of the components can facilitate this assembly.

The patient need not set the reminder of the present invention himself. The pharmacist can select the appropriate indicator 20, 128, 224 for the appropriate dosage schedule, and the patient need never touch the medicine prior to dispensation. Alternately, the patient can set the reminder after the first dose is taken. Accidental contamination and spillage are thus avoided.

The memory aid of the present invention can be included with any medicine, and the patient need make no special effort to obtain its advantages.

Although specific embodiments of the present invention have been described in detail herein with reference to the accompanying drawings, it is to be understood that the invention is not limited to those precise embodiments, and that various changes and modifications may be effected therein by one skilled in the art without departing from the spirit and scope of the invention as defined in the appended claims.

What is claimed is:

1. A memory aid for use with a vial for containing a substance to be dispensed at predetermined times, said vial having a top rotatably positioned thereon, comprising:

attachment top means having a cavity therein;

reminder means for moving relative to said attachment top means to indicate one in a sequence of predetermined times for dispensing said substance;

locking means for preventing relative movement between said reminder means and said attachment top means in one direction and permitting relative movement between said reminder means and said attachment top means in another direction; and attachment base means positioned within said attachment top means for securely attaching said attachment top means to said top of said vial to prevent relative rotation between said attachment base means and said top, said attachment base means being dimensioned to contain said top.

2. The memory aid of claim 1; wherein said reminder means is dimensioned for rotational movement relative to said attachment top means, and said reminder means and said locking means are disposed within said attachment top means.

3. The memory aid of claim 2; wherein said attachment top means includes a ratchet operable in a first rotational direction and positioned on an inner surface thereof; and said locking means includes a first ratchet operable in said first rotational direction for cooperating with said ratchet on said attachment top means.

4. The memory aid of claim 3; wherein said attachment base means includes a ratchet operable in the opposite direction of said ratchet on said attachment top means; and said locking means includes a second ratchet operable in said opposite direction for cooperating with said ratchet on said attachment base means.

5. The memory aid of claim 4; wherein said locking means includes a disc-shaped central portion with a median plane therethrough; and wherein said first ratchet is positioned substantially above said median plane, and said second ratchet is positioned substantially below said median plane.

6. The memory aid of claim 5; wherein said reminder means includes a plurality of indicia formed on said locking means.

7. The memory aid of claim 6; wherein said attachment top includes an aperture through which one of said indicia is visible.

8. The memory aid of claim 1; and further comprising biasing means positioned between said attachment base means and said locking means for normally biasing said locking means for free rotation with respect to said attachment base means.

9. The memory aid of claim 8; wherein said top of said vial has a shoulder portion and a diameter; and wherein said attachment base means includes a shoulder portion dimensioned to fit substantially over said shoulder of said top, and has a diameter to fit snugly over said diameter of said top.

10. The memory aid of claim 9; wherein said attachment base means includes a retaining ring positoned about said shoulder for retaining said top of said vial substantially within said attachment base means and substantially preventing lateral movement therebetween.

11. The memory aid of claim 9; wherein said top has a plurality of grooves and ridges on an outer surface of said shoulder thereof, and said attachment base means has a plurality of grooves and ridges on an inner surface of said shoulder thereof for cooperating with said grooves and ridges of said top for snugly retaining said top within said attachment base means and preventing relative rotation therebetween.

12. The memory aid of claim 9; wherein said attachment top means includes a shoulder portion dimensioned to fit over said shoulder of said attachment base means with said locking means and said biasing means contained therein, and has a diameter to fit snugly over said diameter of said attachment base means.

13. The memory aid of claim 12; wherein said attachment top means includes a retaining ring positioned about said shoulder for retaining said attachment base means within said attachment top means and substantially preventing lateral movement therebetween.

14. The memory aid of claim 13; wherein said indicia are a plurality of numerals.

15. A memory aid for use with a vial containing a substance to be dispensed at predetermined times, said vial having a top thereon, comprising:

attachment top means having a cavity and an aperture formed therein, said attachment top means including a ratchet formed on an inner surface thereof and operable in a first rotational direction;

reminder means disposed in said cavity of said attachment top means for moving relative to said attachment top means to indicate one in a sequence of predetermined times for dispensing said substance, said reminder means having a plurality of indicia visible through said aperture in said attachment top means, said reminder means being dimensioned for rotational movement relative to said attachment top means;

locking means for preventing relative rotational movement between said reminder means and said attachment top means in said first rotational direction and permitting relative rotational movement in the other direction, said locking means having a first ratchet operable in said first rotational direction for cooperating with said ratchet on said attachment top means, and a second ratchet operable in said other rotational direction, said locking means having a disc-shaped central portion with a median plane therethrough, said first ratchet being positioned substantially above said plane and said second ratchet being positioned substantially below said plane;

attachment base means disposed in said cavity of said attachment top means for coupling said attachment top means to said top of said vial, said attachment base means being dimensioned to contain said top, said attachment base means further including a ratchet operable in said other rotational direction for cooperating with said second ratchet on said locking means; and biasing means positioned between said attachment base means and said locking means for normally biasing said locking means for free rotation with respect to said attachment base means.

16. The memory aid of claim 8; wherein said biasing means comprises a flexible disc-shaped element with a dome-shaped central portion.

* * * * *